US005898446A

United States Patent [19]

Moriyama

[11] Patent Number: 5,898,446

[45] Date of Patent: Apr. 27, 1999

[54] ACOUSTIC INK JET HEAD AND INK JET RECORDING APPARATUS HAVING THE SAME

[75] Inventor: Jiro Moriyama, Kawasaki, Japan

[73] Assignee: Canon Kabushiki Kaisha, Tokyo, Japan

[21] Appl. No.: 08/801,366

[22] Filed: Feb. 19, 1997

Related U.S. Application Data

[63] Continuation of application No. 08/186,331, Jan. 25, 1994, abandoned.

[30] Foreign Application Priority Data

Jan. 29, 1993 [JP] Japan ..... 5-013334
Jan. 29, 1993 [JP] Japan ..... 5-013335

[51] Int. Cl.[6] ..... B41J 2/135

[52] U.S. Cl. ..... 347/46; 347/48; 347/72

[58] Field of Search ..... 347/7, 15, 48, 347/46, 54, 55, 60, 70, 72

[56] References Cited

U.S. PATENT DOCUMENTS

| | | | |
|---|---|---|---|
| 4,751,530 | 6/1988 | Elrod et al. | 347/46 |
| 5,144,342 | 9/1992 | Kubota | 347/70 |

FOREIGN PATENT DOCUMENTS

| | | | |
|---|---|---|---|
| 0243118 | 10/1987 | European Pat. Off. . | |
| 272092 | 6/1988 | European Pat. Off. | 347/46 |
| 0437062 | 7/1991 | European Pat. Off. . | |
| 0493102 | 7/1992 | European Pat. Off. . | |
| 0516188 | 12/1992 | European Pat. Off. . | |
| 2-217251 | 8/1990 | Japan | 347/68 |
| 3-155948 | 7/1991 | Japan | 347/68 |
| 3-155953 | 7/1991 | Japan | 347/15 |
| 3-243358 | 10/1991 | Japan | 347/72 |
| 4-168050 | 6/1992 | Japan | 347/46 |

OTHER PUBLICATIONS

Krause, "Focusing Ink Jet Head", *IBM Technical Disclousre Bulletin* vol. 16, No. 4, p. 1168, Sep. 1973.

*Primary Examiner*—Benjamin R. Fuller
*Assistant Examiner*—Charles W. Stewart, Jr.
*Attorney, Agent, or Firm*—Fitzpatrick, Cella, Harper & Scinto

[57] ABSTRACT

An electric field is formed between an ink jet recording head and a recording medium on a platen so that a certain intensity of force effective in the direction oriented toward the recording medium is applied to an ink droplet in the presence of the electric field. Whereby, the ejected ink droplet is prevented from being shot onto a dislocated position from a normal position.

14 Claims, 6 Drawing Sheets

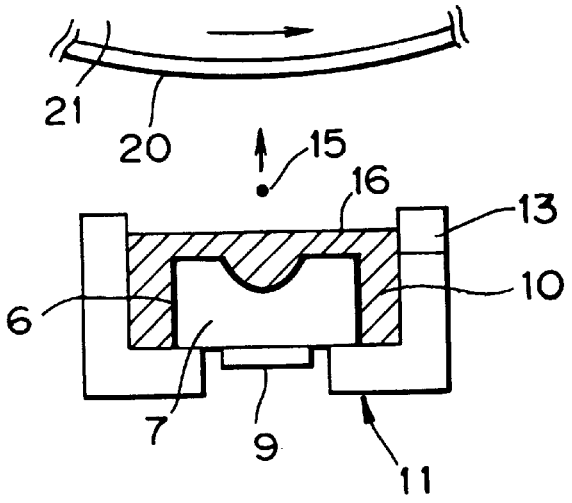
FIG.3
FIG.4A
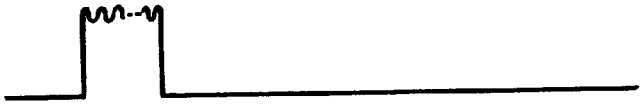
FIG.4B
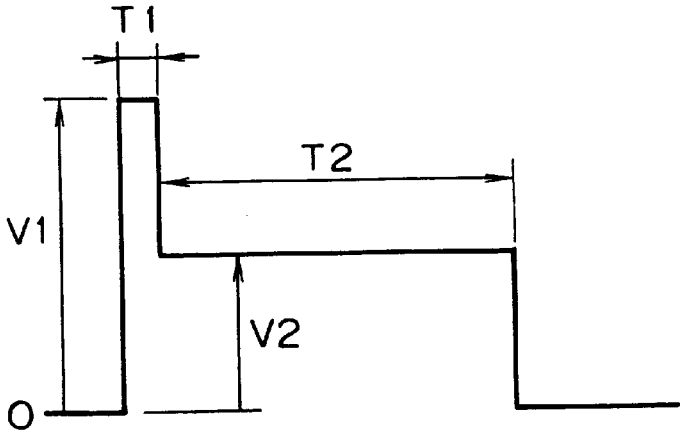

ACOUSTIC INK JET HEAD AND INK JET RECORDING APPARATUS HAVING THE SAME

This application is a continuation of application Ser. No. 08/186,331, filed Jan. 25, 1994, now abandoned.

BACKGROUND OF THE INVENTION

1. Field of the Invention

The present invention relates to an ink jet head of the type wherein ink droplets are ejected from an ink liquid plane by utilizing the effect of collective concentration of a series of waves propagating in ink. Further, the present invention relates to an ink jet apparatus having the foregoing type of ink jet head used therefor.

2. Description of the Prior Art

An ink jet recording apparatus, which is one of the most widely known as apparatuses using an ink jet head, has many advantages that it generates little noises, it can be operated at a low running cost, it can be constructed with small dimensions, and a color printing operation can easily be performed therewith. Owing to the aforementioned advantages, many ink jet recording apparatuses of the foregoing type are put in practical use as information output units each constructed in the form of a printer, a copying machine, a facsimile apparatus or the like.

The ink jet head generally used for the ink jet recording apparatus includes a plurality of ejecting ports (hereinafter referred to also as orifices) each having a diameter ranging from 20 $\mu$m to 300 $\mu$m. In this connection, reduction of the reliability which may occur in the ink jet head has been mostly attributable to malfunctions of the orifices as noted below. Typically, the malfunctions of the orifices arise such that each orifice is clogged with foreign materials such as dust particles or the like, the viscosity of ink is increased in each orifice inclusive of the peripheral part thereof, and each orifice is deformed. In such case as mentioned above, there additionally arises another malfunction in that a quantity of ink to be ejected from the orifices is reduced, and moreover, the ink is incorrectly ejected from the orifices.

In view of the conventional ink jet head constructed in the above-described manner, a proposal has been made with a so-called nozzleless head having no orifice used therefor. An example of the nozzleless head is constructively realized in the form of an acoustic ink jet head such that ink droplets are ejected from an ink liquid plane in the ink jet head by utilizing the effect of collective concentration of a series of waves propagating in ink. A basic principle of ink ejection of the foregoing type has been disclosed, e.g., in IBM Technical Disclosure Bulletin, Vol. 16, NO. 4, September 1973, p. 1168~.

A so-called acoustic ink jet head of the foregoing type is constructed such that a series of pressure waves propagating in the ink are collectively concentrated at a specific spot in the ink jet head. With this construction, the number of dots capable of being simultaneously recorded on a recording medium such as a sheet of recording paper or the like by ejecting ink from the foregoing spot is limited only to one. For this reason, in contrast with other type of ink jet recording apparatus, it is necessary that the acoustic ink jet head is displaced relative to the recording medium at a higher speed.

However, in the case that a high speed recording operation is achieved by shooting onto the recording medium ink droplets ejected from the ink jet head while the recording medium which is immovably wound around a platen (drum) is rotated at a high speed, there sometimes arises an occasion that an air stream generated by the rotation of the platen for the displacement of the ink jet head relative to the recording medium causes the deflection of flying of ejected ink droplets each having a very small volume to be deviated away from the normal direction. This induces a problem that the position where the ink droplets are shot onto the recording medium is dislocated away from the normal position, resulting in a quality of each of recorded items such as characters, images or the like being degraded.

Since the number of dots capable of being simultaneously recorded on the recording medium with the ink droplets ejected from the ink jet head is limited only to one as mentioned above, it is necessary that the ink jet head is displaced relative to the recording medium during each recording operation at a high speed much more than that of other type of ink jet recording apparatus. Due to the foregoing necessity, a specially designed mechanism for displacing the ink jet head relative to the recording medium at a high speed is additionally required, resulting in a product of ink jet apparatus being unavoidably constructed with larger dimensions.

SUMMARY OF THE INVENTION

An object of the present invention is to provide an acoustic ink jet head and an ink jet apparatus having the ink jet head of the foregoing type used therefor wherein ink droplets ejected from the ink jet head can be deposited on a recording medium such as a sheet of recording paper or the like at a very high accuracy without any influence of an air stream generated as the ink jet head is displaced relative to the recording medium, whereby various items such as characters, images or the like each having a high quality can be recorded on the recording medium.

Another object of the present invention is to provide an ink jet apparatus which assures that each recording operation can be performed in a multi-gray level mode.

Another object of the present invention is to provide an ink jet head and an ink jet apparatus which assure that each recording operation can be performed at a series of positions continuously located one after another on a recording medium such as a sheet of recording paper or the like without any necessity for displacing the ink jet head relative to the recording medium at a high speed.

A further object of the present invention is to provide an ink jet apparatus which assures that a recording operation can be achieved in a multi-level mode by changing a volume of each ink droplet ejected from an ink jet head.

Yet a further object of the present invention is to provide an ink jet head including a plurality of ink ejecting portions as well as an ink jet apparatus having the ink jet head of the foregoing type used therefor.

In the first aspect of the present invention, there is provided an ink jet apparatus which has an ink jet head for ejecting ink from an ink liquid plane thereof by utilizing an effect of collective concentration of a series of waves propagating in ink, and which ejects ink from the ink jet head to a medium, the apparatus comprising:

driving means for generating the series of waves in the ink jet head so as to eject ink; and means for forming an electric field between the medium and the ink jet head so as to apply force on ink at least when the ink is ejected from the ink jet head.

In the second aspect of the present invention, there is provided an ink jet head for ejecting ink from an ink liquid plane thereof by utilizing an effect of collective concentration of a series of waves propagating in ink, comprising:

a plurality of electro-mechanical converting elements each of which can be deformed to generate the series of waves, the elements being arranged in predetermined form; and an electrode for permitting the plurality of electro-mechanical converting elements to be selectively driven so as to be deformed.

In the third aspect of the present invention, there is provided an ink jet apparatus which has an ink jet head for ejecting ink from an ink liquid plane thereof by utilizing an effect of collective concentration of a series of waves propagating in ink, comprising:

a plurality of electro-mechanical converting elements each of which can be deformed to generate the series of waves, the elements being arranged in predetermined form; and an electrode for permitting the plurality of electromechanical converting elements to be selectively driven so as to be deformed, and which ejects ink from the ink jet head to a medium, the apparatus comprising:

driving means for selectively driving the plurality of electro-mechanical converting elements through the electrode; and ejection control means for controlling the driving means so as to form a concave surface over upper end surfaces of the electro-mechanical converting elements related to ink ejection, and to vibrate the electro-mechanical converting elements related to ink ejection at higher frequency than that when the concave surface is formed.

In the fourth aspect of the present invention, there is provided an ink jet apparatus which has an ink jet head for ejecting ink from an ink liquid plane thereof by utilizing an effect of collective concentration of a series of waves propagating in ink, comprising:

a plurality of electro-mechanical converting elements each of which can be deformed to generate the series of waves, the elements being arranged in predetermined form; and an electrode for permitting the plurality of electromechanical converting elements to be selectively driven so as to be deformed, and which ejects ink from the ink jet head to a medium, the apparatus comprising:

driving means for selectively driving the plurality of electro-mechanical converting elements through the electrode;

ejection control means for controlling the driving means so as to form a concave surface over upper end surfaces of the electro-mechanical converting elements related to ink ejection, and to vibrate the electro-mechanical converting elements related to ink ejection at higher frequency than that when the concave surface is formed; and means for forming an electric field between the medium and the ink jet head so as to exert force on ink at least when the ink is ejected from the ink jet head by the driving means.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which:

FIG. 3 is a fragmentary enlarged cross-sectional view of the ink jet recording head shown in FIG. 1 and FIG. 2, schematically showing the detailed structure of a recording head for the ink jet recording apparatus;

FIGS. 4A and 4B are wave diagrams which show an output timing relationship associated with a high voltage generating circuit for an ink jet recording apparatus constructed according to a modified embodiment of the present invention;

DESCRIPTION OF THE PREFERRED EMBODIMENTS

The present invention will now be described in detail hereinafter with reference to the accompanying drawings which illustrate a few preferred embodiments thereof.

(Embodiment 1)

Figure 1:
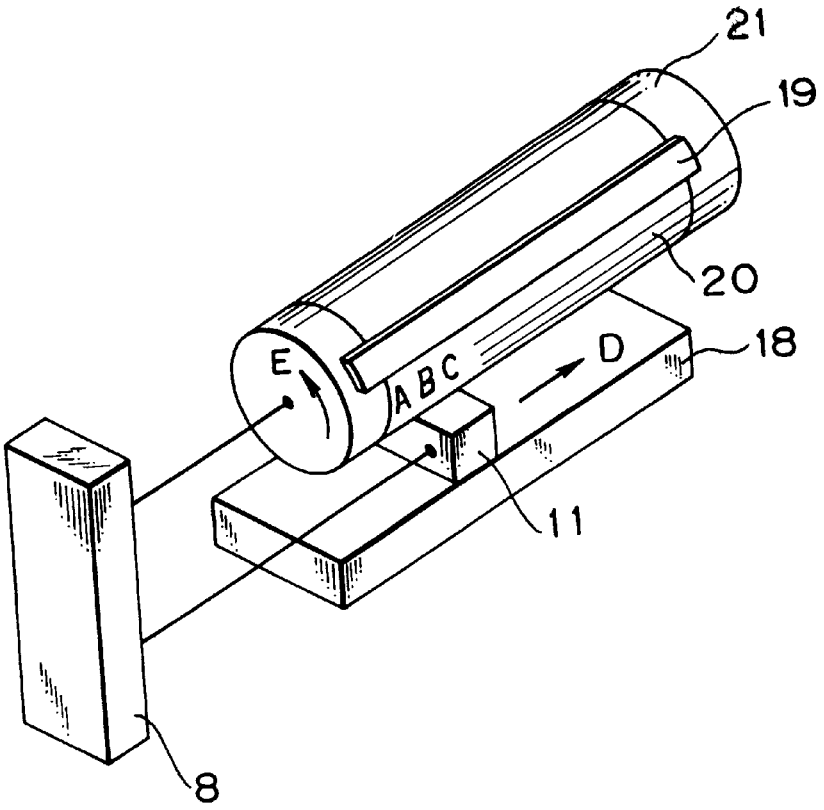
FIG. 1 is a schematic perspective view of an ink jet recording apparatus constructed according to a first embodiment of the present invention, particularly showing essential components constituting the ink jet recording apparatus.
Figure 2:
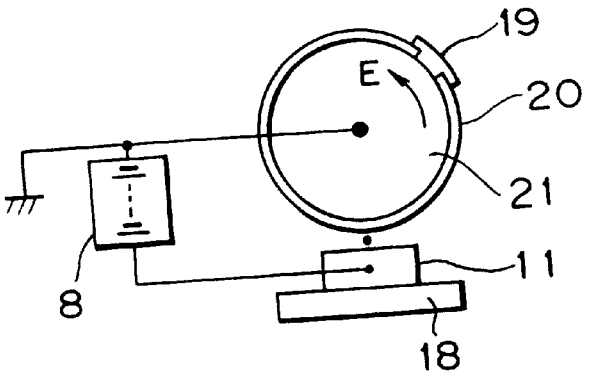
FIG. 2 is a schematic cross-sectional view of the ink jet recording apparatus shown in FIG. 1.

FIG. 1 is a schematic perspective view of an ink jet apparatus constructed according to a first embodiment of the present invention, particularly showing essential components constituting the ink jet recording apparatus, and FIG. 2 is a schematic cross-sectional view of the ink jet recording apparatus shown in FIG. 1.

As shown in the drawings, the recording apparatus includes a platen (drum) 21, and a recording medium 20 such as a sheet of recording paper or the like is wound around the platen 21 while it is firmly held on the platen 21 by a retaining member 19. The outer peripheral surface of the platen 21 has electrical conductivity while it is electrically connected to the rotational central part of the platen 21, whereby the outer peripheral surface of the platen 21 is kept equal voltage to a case (not shown) of the recording apparatus. The platen 21 is rotatably supported with the aid of a supporting mechanism (not shown) so that it can be rotated at a high speed in the E arrow-marked direction. In addition, the recording apparatus includes a recording head 11 adapted to eject ink droplets in conformity with the aforementioned acoustic principle, and the recording head 11 can reciprocably be displaced not only in the D arrow-marked direction but also in the reverse direction by actuating a linear motor 18. As the platen 21 is rotated and the recording head 11 is linearly displaced by means of the linear motor 18 in one of the opposite directions, all the positions continuously located on the recording medium 20 can be scanned by the recording head 11 so as to enable characters and others or a variety of images to be recorded on the recording medium 20.

Additionally, the recording apparatus includes a high voltage generating circuit 8 in order to generate an electric field between the recording medium 20 and an ink liquid plane in the recording head 11 at substantially same timing to the ink ejection. In this embodiment, a magnitude of the electric field is set to 800 v/mm. As ink droplets are ejected from the recording head 11, a certain intensity of force effective in the direction orienting toward the recording medium 20 is given to each ink droplet in the presence of the electric field, causing the ink droplets to fly toward the recording medium 20 in the accelerated state until they are shot onto the recording medium 20. Since the electric field effective in the direction orienting toward the recording medium 20 from the recording head 11 is generated, there does not arise a malfunction that the direction of flying of the ink droplets ejected from the recording head 11 is deviated from the normal direction under the influence of an air stream generated as the platen 21 is rotated. To this end, it is recommendable that the magnitude of the electric field is set to the range from about 200 to 2000 v/mm.

FIG. 3 is a fragmentary enlarged cross-sectional view of the recording apparatus shown in FIG. 1 and FIG. 2, schematically showing the inner structure of the recording head 11.

As is apparent from the drawing, an ink 10 is received in the recording head 11. To detect a quantity of the ink received in the recording head 11, i.e., to detect an ink liquid plane 16 in the recording head 11, an ink liquid plane sensor 13 is disposed on the right-hand side wall of the recording head 11 as seen in FIG. 3. When it is detected by the ink liquid plane sensor 13 that a quantity of the ink received in the recording head 11 is smaller than a predetermined quantity, ink is additionally fed into the recording head 11 with the aid of an ink feeding mechanism (not shown). The ink liquid plane sensor 13 is prepared in the form of a reflection type photosensor in order to detect whether or not ink is received in the recording head 11 sufficient to reach a predetermined level.

Ejection of an ink droplet 15 is achieved in the following manner.

The recording head 11 includes a piezo-electric element 9, and when an AC voltage having a high frequency, for example, at 80 $V_{p-p}$ and 100 KHz is applied to the piezo-electric element 9, the latter is vibrated and each vibration of the piezo-electric element 9 is then transmitted to a solid base plate 7. Subsequently, as the solid base plate 7 is vibrated, each vibration of the solid base plate 7 is transmitted to the ink 10 via a thin film 6, causing a pressure wave to be generated by the vibration of the solid base plate 7. At this time, the thin film 6 is kept in contact with the solid base plate 7 and serves to maintain proper acoustic impedance matching in such a manner as to allow the pressure wave generated by the vibration of the piezo-electric element 9 to effectively propagate in the ink 10. In addition, the thin film 6 serves as an electrode for generating the above-described electric field effective between the ink liquid plane 16 and the recording medium 20. As a series of pressure waves propagate in the ink 10, they are collectively concentrated at a substantially single spot on the ink liquid plane 16, causing an ink droplet 15 to be ejected from the foregoing spot on the ink liquid plane 16 in the upward direction. As the ink droplet 15 is ejected in that way, a certain intensity of force effective in the direction orienting toward the recording medium 20 is applied to the ink droplet 15 in the presence of the electric field generated between the electrical conductive thin film 6 and the electrical conductive platen 21 so as to enable the ink droplet 15 to be shot onto a predetermined position on the recording medium 20 at a high accuracy. The ejected ink droplet is charged just when the ink droplet is separated from the ink liquid plane of the recording head 11.

The first embodiment of the present invention has been described above with respect to the case that a piezo-electric element is employed as a source for generating a series of pressure waves to propagate in the ink. However, the present invention should not be limited only to the piezo-electric element but any type of element may be employed as a pressure wave generating source, provided that it is proven that a series of pressure waves can be generated by using this element.

(Embodiment modified from Embodiment 1)

According to the first embodiment of the present invention, an AC voltage outputted from the high voltage generating circuit 8 for generating the electric field effective between the ink jet head and the recording medium is generated as a constant high voltage. However, the present invention should not be limited only to this type. In circumstances as mentioned above, another example of the voltage application will be described below.

FIG. 4A is a timing diagram which shows an output timing relationship for applying a driving voltage to a piezo-electric element 9 for the purpose of ink ejection in a modified embodiment of the present invention, and FIG. 4B is a wave diagram which shows an output timing relationship for a high voltage to be outputted from the high voltage generating circuit 8 in synchronization with the application of the driving voltage.

In FIGS. 4A and 4B, reference character T2 designates a time that elapses while a certain intensity of force is applied to an ejected ink droplet in the presence of an electric field, and reference character T1 designates the width of a voltage pulse to be applied to an ink droplet in the foregoing timing relationship wherein a voltage higher than that in the case of the time T2 is outputted from the high voltage generating circuit 8. In this case, in contrast with the case that T1 is set to be equal to T2, a larger ink droplet can be ejected from the ink jet head. In addition, when V1 is enlarged and/or T1 is elongated, an ink droplet larger than in the preceding case can be ejected from the ink jet head.

Thus, a volume of each ejected ink droplet can be changed by properly controlling a magnitude of voltage at the time when it is ejected from the ink jet head and/or a time of voltage application. In other words, each recording operation can be achieved in a multi-gray level mode by changing a size of the ink droplet to be shot onto a recording medium such as a sheet of recording paper or the like. Also in the case that the volume of an ink droplet to be ejected from the ink jet head is set to a constant value irrespective of the variation of a temperature of ink to be used and components contained in the ink, the volume of each ink droplet can be changed as desired.

The modified embodiment of the present invention shown in FIG. 4A and FIG. 4B has been described above with respect to the case that a pulse having a pulse width T1 is outputted from a controller (not shown) at the same line when a driving voltage is applied to a piezo-electric element 9. Alternatively, the pulse having the pulse width T1 may be outputted from the controller in the timing relationship slightly ahead of the time when the driving voltage is applied to the piezo-electric element 9. Otherwise, the pulse having the pulse width T1 may be outputted from the controller at the approximately same time as the time when the driving voltage is applied to the piezo-electric element 9 while a constant voltage V2 is normally applied to the same. It of course is obvious that in the case that the volume of each ink droplet is adequately controlled by the controller (not shown) in order to achieve each recording operation in a multi-gray level mode, the voltage V1 may assume a value smaller than that of the voltage V2.

(Embodiment 2)

Figure 5:
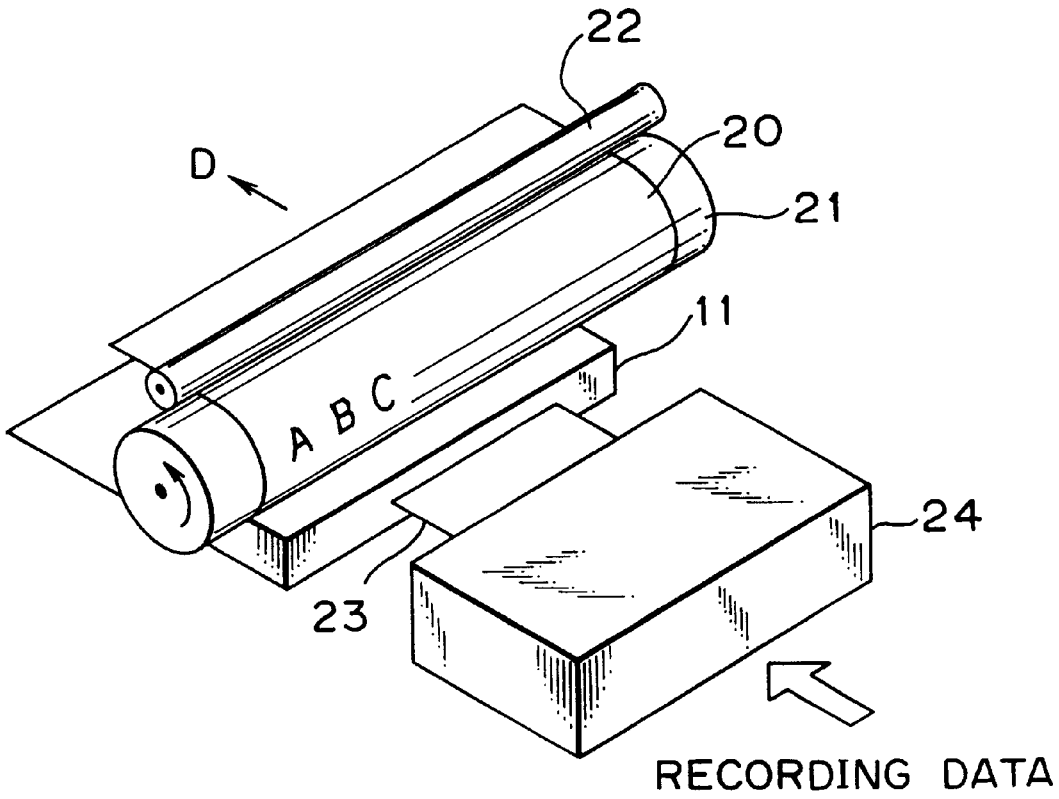
FIG. 5 is a schematic perspective view of an ink jet recording apparatus having an ink jet head used therefor and constructed according to a second embodiment of the present invention, particularly showing essential components constituting the recording apparatus.

FIG. 5 is a schematic perspective view of an ink jet recording apparatus having an ink jet head used therefor and constructed according to a second embodiment of the present invention, particularly showing essential components constituting the recording apparatus.

Referring to the drawing, a recording medium 20 such as a sheet of recording paper or the like is transported in the condition that the recording medium 20 is wound around a platen 21. As the platen 21 and a paper discharging roller 22 to cooperate with the platen 21 are rotated, the recording medium 20 is stepwise conveyed in the D arrow-marked direction. In the meantime, an ink droplet is ejected from the ink jet head 11 toward the recording medium 20 so as to record various items and others, images or the like with the ejected ink droplets. The ink jet head 11 adapted to eject an ink droplet in conformity with the aforementioned acoustic principle is immovably mounted on a case of the recording apparatus. Recording data inputted from a host computer or the like are converted into signals for selectively driving a plurality of piezo-electric elements to be described later for the ink jet head 11 in a head driving circuit 24, and subsequently, the signals are fed to the ink jet head 11 via a cable 23 as driving signals.

Figure 6A:
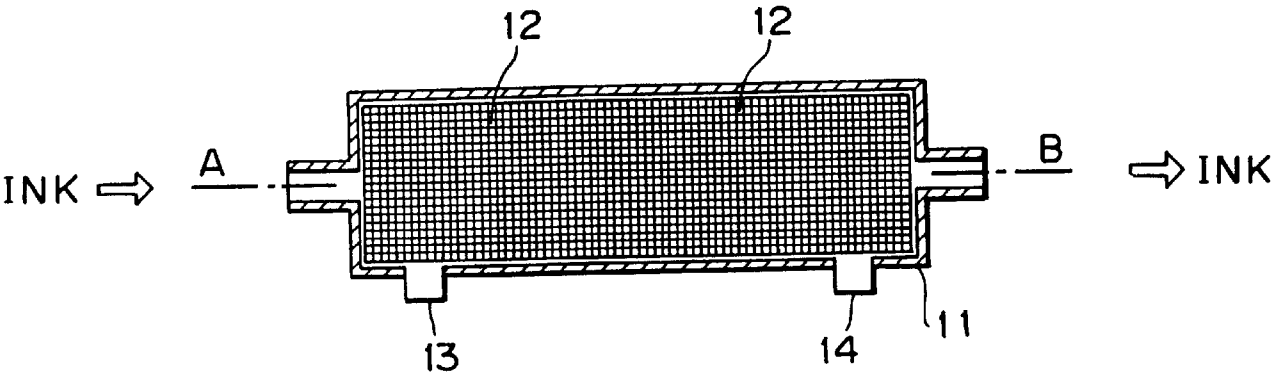
FIG. 6A is a schematic plan view of the ink jet head shown in FIG. 5.
Figure 6B:
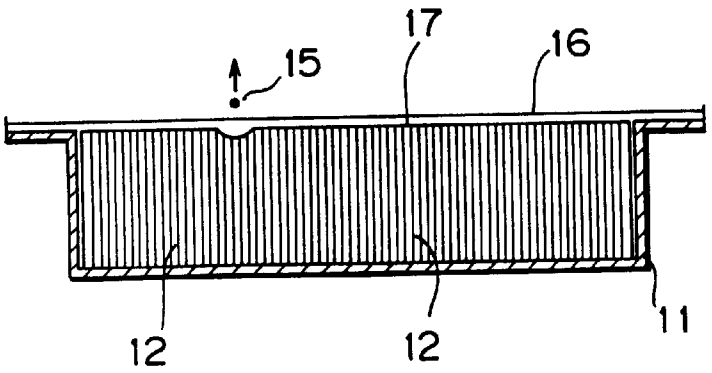
FIG. 6B is a sectional view of the ink jet head taken along line A-B in FIG. 6A.

FIG. 6A is a schematic plan view of the ink jet head 11 shown in FIG. 5, and FIG. 6B is a sectional view of the ink jet head 11 taken along line A-B in FIG. 6A.

Referring to FIG. 6A, ink is supplied to the ink jet head 11 from the A side of the latter and then discharged from the B side of the same. A quantity of the ink received in the ink jet head 11 is detected by a first ink liquid plane sensor 13 and a second ink liquid plane sensor 14. When it is detected by both the ink liquid plane sensors 13 and 14 that a quantity of ink smaller than a predetermined one is received in the ink jet head 11, ink is additionally supplied to the ink jet head 11 from the A side of the latter with the aid of an ink supplying mechanism (not shown). Each of the ink liquid plane sensors 13 and 14 is prepared in the form of a reflection type photosensor so that it is practically used for detecting whether the ink received in the ink jet head 11 reaches a predetermined level or not.

A signal fed to the ink jet head 11 from the head driving circuit 24 is applied to a piezo-electric element 12 arranged in the ink jet head 11. As will be described later with reference to FIG. 7, each piezo-electric element 12 is designed in the form of an elongated column having a square cross-sectional shape, and as shown in FIG. 6A, a number of piezo-electric elements 12 each designed in that way are arranged in the form of a matrix composed of a plurality of lines and a plurality of rows extending at a right angle relative to the lines. A thin film layer 17 is kept in contact with an end surface of each of the piezo-electric elements 12 arranged in the above-described manner. The placement of the thin film layer 17 in that way is intended to prevent the ink from coming in direct contact with the piezo-electric elements 12, to maintain proper acoustic impedance matching in order to allow a series of pressure waves generated as the piezo-electric elements 12 are vibrated to effectively propagate in the ink, and to protect the piezo-electric elements from the ink.

FIG. 6B shows the operative state of the ink jet head 11 that an ink droplet 15 is ejected in the arrow-marked direction. At this time, a certain magnitude of AC voltage is preliminarily applied to each of the piezo-electric elements 12 located below the ejected ink droplet 15, and the upper end surfaces of the respective piezo-electric elements 12 arranged in the side-by-side relationship form a single slight concave surface as a whole. At the time of ink ejection, an AC voltage having a high frequency is applied to each of the piezo-electric elements 12, causing the latter to be vibrated. The slight concave surface defined by the upper end surfaces of the respective piezo-electric elements 12 in the above-described manner is intended to collectively concentrate the pressure waves irradiated from the respective piezo-electric elements 12 at the positions located in the vicinity of the ink liquid plane 16 as the piezo-electric elements 12 are vibrated.

In more detail, on receipt of the recorded data, the head driving circuit 24 is activated, and subsequently, when an AC voltage having a comparative low frequency is applied to the respective piezo-electric elements 12, the positions of the upper end surfaces of the piezo-electric elements are properly controlled by the controller (not shown) so as to form a slight concave surface over the upper end surfaces of the piezo-electric elements 12. In addition, when an AC voltage having a comparatively high frequency is applied to the piezo-electric elements 12 forming the concave surface, the latter are vibrated, causing the ink to resonate in response to the vibrations.

A volume of each ink droplet to be ejected from the ink jet head 11 can be controlled by the controller (not shown) by controlling the extent of deformation of the slight concave surface extending over the upper end surfaces of the piezo-electric elements 12. Thus, the volume of each ejected ink droplet can be maximized by adequately determining the extent of deformation of the slight concave surface. In the case that the extent of deformation of the slight concave surface is enlarged in excess of the extent available at the time of maximum deformation of the same or in the case that it is reduced in excess of the same, a volume of each ejected ink droplet is reduced. In addition, in the case that the slight concave surface is not formed, any ink droplet is not ejected from the ink jet head 11 even when each of the piezo-electric elements 12 is driven by an AC voltage having a comparatively high frequency. As is apparent from the above description, since the ink jet head 11 makes it possible to control a volume of each ejected ink droplet as desired, each recording operation can be achieved in a multi-gray level mode while the size of an ink dot recorded on a recording medium is correspondingly controlled by the controller (not shown).

In such manner, selective ink ejection is sequentially carried out from the left-hand side to the right-hand side as seen in FIG. 6A, i.e., from the A side to the B side as seen in the drawing as the ink ejecting position is displaced in the arrow-marked direction, i.e., in the rightward direction. Thus, a recording operation is completed with first scanning effected at the same time, by repeating the foregoing selective ink ejection in a single direction as mentioned above.

After completion of the first scanning and recording operations, a second scanning operation and subsequent ones are repeated in the same manner as mentioned above, and at the same time, the recording medium 20 is stepwise conveyed further every time each scanning operation is completed, whereby various items such as characters, images or the like can be recorded over the whole area of the recording medium 20 by repeating the aforementioned recording operation.

Figure 7:
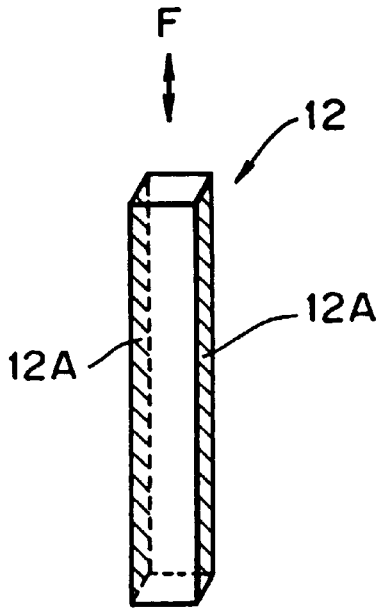
FIG. 7 is a schematic perspective view of an piezo-electric element employable for the ink jet head constructed according to the second embodiment of the present invention.

FIG. 7 is a schematic perspective view of a piezo-electric element employable for practicing the second embodiment of the present invention, particularly showing a three-dimensional configuration thereof.

As shown in the drawing, the piezo-electric element designated by reference numeral 12 is designed in the form of an elongated column having a square cross-sectional shape and includes two electrodes 12A, 12A on two side surfaces thereof facing to each other. In the shown case, each of the electrodes 12A is identified by a plurality of hatched lines, and the direction of polarization is oriented in the same direction as that of each electrode 12A. In this case, a strain of each piezo-electric element 12 appears in the F arrow-marked direction orienting at a right angle relative to the direction of each electrode 12A (i.e., vertical deformation of the piezo-electric element 12 is caused in the F arrow-marked direction). As mentioned above with reference to FIG. 6A and FIG. 6B, a number of piezo-electric elements 12 are two-dimensionally arranged in the ink jet head 11. Additionally, a sealing member (not shown) is sealably disposed between adjacent piezo-electric elements 12 to serve not only as an electrical insulative member but also as a reinforcing member for each piezo-electric element 12.

(Embodiment modified from Embodiment 2)

Figure 8:
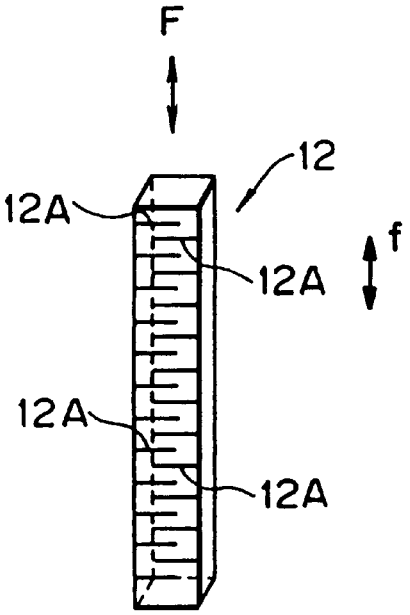
FIG. 8 is a schematic perspective view of another piezo-electric element which can be used for the ink jet head constructed according to the second embodiment of the present invention.

In the preceding embodiment, each piezo-electric element is designed in the form of an elongated column having a square cross-sectional shape such that it is strained or deformed in the direction orienting at a right angle relative to the direction of polarization. However, the present invention should not be limited only to the configuration and the structure as mentioned above. Alternatively, as shown in FIG. 8, a piezo-electric element may be designed in a laminated structure including a plurality of electrodes and a plurality of piezo-electric elements alternately laminated one above another such that it is strained or deformed in the same direction as that of polarization shown by arrow f (i.e., in the transverse direction). An advantageous effect of the piezo-electric element constructed according to the modified embodiment of the present invention is that a value of AC voltage for deforming a group of piezo-electric elements so as to form a slight concave surface with them can be set to be comparatively small.

(Another Embodiment modified from Embodiment 2)

According to the second embodiment of the present invention, only one ink droplet is ejected from the ink jet head 11 at a certain same time. Alternatively, a plurality of ink droplets, e.g., two ink droplets may simultaneously be ejected from the ink jet head 11.

Figure 9:
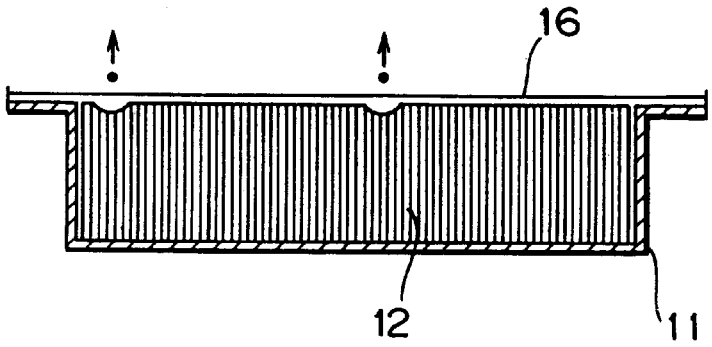
FIG. 9 is a sectional view of an ink jet head constructed according to another modified embodiment of the present invention, particularly showing that two ink droplets are ejected from an ink jet head.

FIG. 9 shows the case that two ink droplets are ejected from a ink jet head at a certain same time. To this end, it is required that the head driving circuit 24 is activated to control a magnitude of AC voltage to be applied to a group of piezo-electric elements with the aid of the controller (not shown) in such a manner as to simultaneously eject two ink droplets from an ink jet head 11. When a controlling operation is achieved for the ink jet head 11 in that way, it is possible to simultaneously eject three or more ink droplets from the ink jet head 11. In this case, care should be taken such that a group of piezo-electric elements arranged corresponding to each of the ink droplets does not permit a series of pressure waves to interfere with each other. In some cases, one ink droplet may be ejected from the ink jet head 11 with very short delay from another ink droplet or the remaining ink droplets.

(Embodiment 3)

Figure 10:
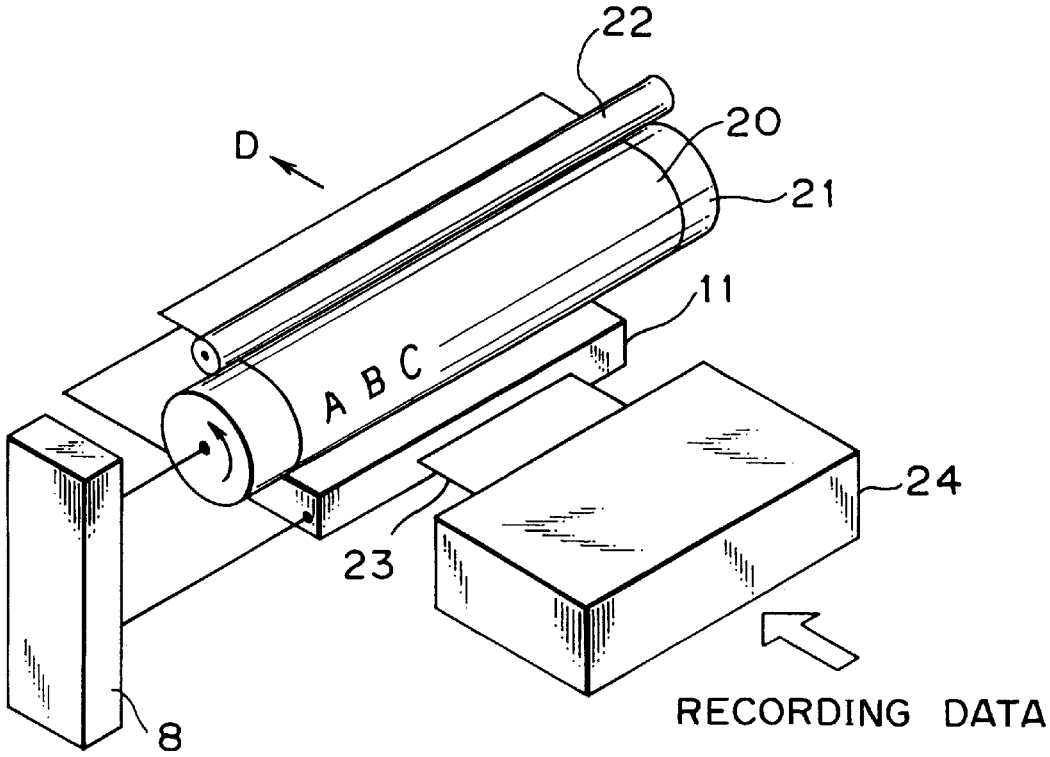
FIG. 10 is a schematic perspective view of an ink jet apparatus constructed according to a third embodiment of the present invention.

FIG. 10 is a schematic perspective view of an ink jet recording apparatus constructed according to a third embodiment of the present invention.

In practice, the third embodiment of the present invention is practiced by combining the technical concept of the first embodiment of the present invention with the technical concept of the second embodiment of the same. A plurality of piezo-electric elements are crosswise arranged in an ink jet head 11 in the same manner as shown in FIG. 6A and FIG. 6B, and when ink droplets are ejected from the ink jet head 11, a high voltage generating circuit 8 is activated to generate an electric field effective between an ink liquid plane in the ink jet head 11 and a recording medium 20 such as a sheet of recording paper or the like.

With this construction, a film 17 as shown in FIG. 6B can be employed as an electrode for generating an electric field on the ink jet head 11 side. In this case, the electric field is basically generated within the range corresponding to the whole ink liquid plane in the ink jet head 11 but the electrode on the ink jet head 11 side may be divided into a plurality of electrode segments, e.g., by combining the film 17 with a plurality of wiring conductors arranged in a matrix-shaped pattern. By doing so, a plurality of local electric fields can be generated, and moreover, the direction of orienting of each local electric field can be controlled by the controller (not shown) as desired in order to control the position where each ink droplet is shot onto the recording medium 20 at a higher accuracy.

While the present invention has been described above with respect to a few preferred embodiments inclusive of modified embodiments thereof, it should of course be understood that the present invention should not be limited only to these embodiments but various changes or modifications may be made without any departure from the scope of the present invention as defined by the appended claims.

What is claimed is:

1. An ink jet apparatus using an ink jet head for ejecting ink from an ink liquid plane of the ink jet head by utilizing an effect of collective concentration of a series of waves propagating in the ink, the ink being ejected from the ink jet head to a medium, said apparatus comprising:

driving means for generating the series of waves in said ink jet head so as to eject the ink; and means for forming an electric field between the medium and said ink jet head so as to apply force on the ink by intermittently generating a predetermined voltage difference between the medium and said ink jet head at a substantially same timing as or slightly ahead of a timing of application of a driving voltage by said driving means for ink ejection from said ink jet head.

2. An ink jet apparatus as claimed in claim 1, wherein the predetermined voltage difference between the medium and said ink jet head is caused by a voltage pulse generated by a voltage generating circuit, and another voltage difference having a voltage value of a voltage pulse different from that of the predetermined voltage difference is generated when no ink is ejected.

3. An ink jet apparatus as claimed in claim 2, wherein the voltage value and/or width of the voltage pulse generated when ink is ejected can be varied.

4. An ink jet apparatus as claimed in claims 3, wherein said ink jet head is used for performing recording onto a recording medium as the medium, the recording medium is displaced while performing recording.

5. An ink jet apparatus as claimed in claim 4, wherein said driving means comprises an electro-mechanical converting element which generates the series of waves propagating in the ink.

6. An ink jet apparatus using an ink jet head for ejecting ink from an ink liquid plane of the ink jet head by utilizing an effect of collective concentration of a series of waves propagating in the ink, said ink jet head comprising a plurality of electro-mechanical converting elements each of which can be deformed to generate the series of waves, said elements being arranged in a predetermined form, and electrodes for applying electric energy to said plurality of electro-mechanical converting elements to be selectively driven so as to be deformed, and the ink being ejected from the ink jet head to a medium, said ink jet apparatus comprising:

driving means for selectively driving said plurality of electro-mechanical converting elements through said electrodes so that a predetermined plural number of the electromechanical converting elements related to ink ejection deform and collaborate to form one concave surface for ejecting substantially one ink droplet, and the predetermined number of electro-mechanical converting elements related to ink ejection vibrate at a higher frequency than a frequency when said concave surface is formed.

7. An ink jet apparatus as claimed in claim 6, wherein said driving means displaces said electro-mechanical converting elements related to ink ejection so that ink can be ejected from continuous positions of said ink jet head.

8. An ink jet apparatus as claimed in claim 7, wherein said driving means controls an extent of deformation of said concave surface so that a volume of ejected ink can be varied.

9. An ink jet apparatus as claimed ink claim 8, wherein a plurality of groups of the electro-mechanical converting elements related to ink ejection are positioned in said ink jet head so that two or more ink droplets are ejected simultaneously.

10. An ink jet apparatus which comprises an ink jet head for ejecting ink from an ink liquid plane of the ink jet head by utilizing an effect of collective concentration of a series of waves propagating in the ink, said ink jet head comprising a plurality of electro-mechanical converting elements each of which can be deformed to generate the series of waves, said elements being arranged in a predetermined form, and electrodes for applying electric energy to said plurality of electro-mechanical converting elements to be selectively driven so as to be deformed, and the ink being ejected from the ink jet head to a medium, said ink jet apparatus comprising:

driving means for selectively driving said plurality of electro-mechanical converting elements through said electrodes so that a predetermined plural number of the electro-mechanical converting elements related to ink ejection deform and collaborate to form one concave surface for ejecting substantially one ink droplet, and the predetermined number of electro-mechanical converting elements related to ink ejection vibrate at a higher frequency than a frequency when said concave surface is formed; and means for forming an electric field between the medium and said ink jet head so as to exert force on the ink by intermittently generating a predetermined voltage difference between the medium and said ink jet head at a substantially same timing as or slightly ahead of a timing of application of a driving voltage by said driving means for ink ejection from said ink jet head.

11. An ink jet apparatus as claimed in claim 6, wherein each of said plurality of electro-mechanical converting elements is in a form of a unitary elongated body, and is strained in a longitudinal direction of said element by the driving through said electrodes.

12. An ink jet apparatus as claimed in claim 6, wherein each of said plurality of electro-mechanical converting elements is in a laminated structure including a plurality of electrodes and a plurality of piezo-electric elements, and is strained in a same direction as a direction of polarization of said plurality of electrodes.

13. An ink jet apparatus as claimed in claim 10, wherein each of said plurality of electro-mechanical converting elements is in a form of a unitary elongated body, and is strained in a longitudinal direction of said element by the driving through said electrodes.

14. An ink jet apparatus as claimed in claim 10, wherein each of said plurality of electro-mechanical converting elements is in a laminated structure including a plurality of electrodes and a plurality of piezo-electric elements, and is strained in a same direction as a direction of polarization of said plurality of electrodes.

* * * * *

UNITED STATES PATENT AND TRADEMARK OFFICE

CERTIFICATE OF CORRECTION

PATENT NO. : 5,898,446

DATED : April 27, 1999

INVENTOR(S) : JIRO MORIYAMA

It is certified that error appears in the above-identified patent and that said Letters Patent is hereby corrected as shown below:

COLUMN 1,
Line 20, "noises," should read --noise,--.

COLUMN 3,
Line 19, "electrome-" should read --electro- --;
Line 20, "chanical" should read --mechanical--;
Line 42, "electrome-" should read --electro- --; and
Line 43, "chanical" should read --mechanical--.

COLUMN 4,
Line 26, "an" should read --a--.

COLUMN 7,
Line 1, "line" should read --time--.

COLUMN 9,
Line 59, "from a" should read --from an--.

COLUMN 11,
Line 1, "claims" should read --claim--;

UNITED STATES PATENT AND TRADEMARK OFFICE

CERTIFICATE OF CORRECTION

PATENT NO. : 5,898,446

DATED : April 27, 1999

INVENTOR(S) : JIRO MORIYAMA

It is certified that error appears in the above-identified patent and that said Letters Patent is hereby corrected as shown below:

COLUMN 11 (Cont.),
Line 24, "electromechanical" should read --electro-mechanical--; and
Line 39, "ink" (second occurrence) should read --in--.

Signed and Sealed this

Thirtieth Day of November, 1999

*Attest:*

*Attesting Officer*

Q. TODD DICKINSON

*Acting Commissioner of Patents and Trademarks*